US008430385B2

(12) United States Patent
Weigelt

(10) Patent No.: US 8,430,385 B2
(45) Date of Patent: Apr. 30, 2013

(54) WEDGE DRIVE WITH SLIDER RECEIVING MEANS

(76) Inventor: Harald Weigelt, Kurten (DE)

( * ) Notice: Subject to any disclaimer, the term of this patent is extended or adjusted under 35 U.S.C. 154(b) by 1187 days.

(21) Appl. No.: 12/235,446

(22) Filed: Sep. 22, 2008

(65) Prior Publication Data

US 2009/0078067 A1 Mar. 26, 2009

Related U.S. Application Data

(60) Provisional application No. 60/974,748, filed on Sep. 24, 2007.

(51) Int. Cl.
*B25B 5/14* (2006.01)

(52) U.S. Cl.
USPC ..... 269/43; 269/45; 269/138

(58) Field of Classification Search ..... 269/43, 269/45, 138, 153, 234, 283, 101
See application file for complete search history.

(56) References Cited

U.S. PATENT DOCUMENTS

| | | | | |
|---|---|---|---|---|
| 4,515,049 | A * | 5/1985 | Dietz et al. | 82/158 |
| 5,101,705 | A | 4/1992 | Matsuoka | |
| 5,149,071 | A * | 9/1992 | Oliveira | 269/43 |
| 5,197,834 | A * | 3/1993 | Chase et al. | 409/131 |
| 5,269,167 | A | 12/1993 | Gerhart | |
| 5,487,296 | A | 1/1996 | Gerhart et al. | |
| 5,551,795 | A * | 9/1996 | Engibarov | 403/381 |
| 5,904,064 | A | 5/1999 | Higuchi | |
| 6,126,159 | A * | 10/2000 | Dornfeld | 269/138 |
| 7,013,783 | B2 | 3/2006 | Matsuoka | |
| 7,114,364 | B2 | 10/2006 | Weigelt | |
| 7,191,635 | B2 | 3/2007 | Chun et al. | |
| 7,431,502 | B2 | 10/2008 | Fidziukiewicz | |
| 2009/0078067 | A1 * | 3/2009 | Weigelt | 74/104 |

FOREIGN PATENT DOCUMENTS

| | | | |
|---|---|---|---|
| DE | 198 60 178 | C1 | 5/2000 |
| EP | 0 484 588 | A1 | 5/1992 |
| EP | 1 035 965 | B1 | 8/1998 |
| EP | 1035965 | B1 | 8/1998 |
| EP | 1 259 371 | B1 | 12/1999 |
| EP | 1259371 | B1 | 12/1999 |
| EP | 1 197 319 | B1 | 10/2000 |
| EP | 1197319 | B1 | 10/2000 |
| EP | 1362 651 | A1 | 11/2003 |
| JP | 04-138825 | | 5/1992 |
| JP | 11-347654 | A | 12/1999 |
| JP | 2001-1046 | | 1/2001 |
| JP | 2005-246410 | A | 9/2005 |
| KR | 20-1996-0020727 | | 7/1996 |
| KR | 10-2001-0071791 | | 7/2001 |
| KR | 20-0265751 | | 2/2002 |
| WO | WO 99/28117 | | 6/1999 |
| WO | WO 00/02680 | | 1/2000 |
| WO | WO 00/38907 | | 7/2000 |
| WO | WO 02/30659 | A1 | 4/2002 |
| WO | WO 2006/036381 | A2 | 4/2006 |
| WO | WO 2006/136404 | A1 | 12/2006 |

* cited by examiner

*Primary Examiner* — Lee D Wilson
(74) *Attorney, Agent, or Firm* — Knobbe Martens Olson & Bear LLP

(57) ABSTRACT

In a wedge drive comprising a slider element receiving component, a movable slider element and a driver element, wherein sliding surfaces are provided between the slider element and the driver element, a dovetail-like or prism guide is provided between the slider element and the slider element receiving component. The slider element has a portion having a dovetail-like configuration.

29 Claims, 11 Drawing Sheets

WEDGE DRIVE WITH SLIDER RECEIVING MEANS

CROSS REFERENCE TO RELATED APPLICATIONS

This application claims the priority of provisional patent application No. 60/974,748, filed Sep. 24, 2007. The disclosures of the above-referenced application is hereby expressly incorporated by reference in its entirety.

BACKGROUND OF THE INVENTION

1. Field of the Invention

The invention concerns a wedge drive or cotter key comprising a slider element receiving means, a movable slider element and a driver element, wherein sliding surfaces are provided between the slider element and the driver element.

2. Description of the Related Art

A wedge drive which is also referred to as a slider serves basically for diverting pressing forces to stamping or shaping tools in order thereby to be able to cut, perforate or shape in particular regions of bodywork portions, which are of an inclined or undercut configuration. In that arrangement the wedge drive includes at least one slider element receiving means, a movable slider element and a driver element. The slider element receiving means which as such as rigid is usually connected to a part of the press or the pressing tool, in which press or pressing tool the wedge drive is intended to implement the stamping or shaping operations. A wedge drive is referred to as an upper part slider if the slider element receiving means thereof is fixed in the upper part of the pressing tool, which is connected to the moving pressing ram. Reference is made to a lower part slider if the slider element receiving means thereof is connected to the lower pressing tool which is fixed on the rigid press table. Irrespective of the part to which the slider element receiving means of the wedge drive is connected, it usually has a linear guide means in which the movable slider element is reciprocatable, but as such it is fixedly connected to the slider element receiving means. The driver element is usually in the form of a rigid element fixedly connected to the part of the pressing tool, to which the slider element receiving means is not fastened. The driver element usually has inclined wedge portions and therewith serves as a drive element in relation to the movable slider element.

In the situation involving a substantially perpendicular advance movement of a pressing tool, which is referred to as the working stroke, the slider element which is in its rearward position comes to bear against the rigidly standing driver element and supported thereby is advanced by way of the inclined positioning thereof (wedge shape) facing in the working direction. In that situation the inclination of the linear guide means of the slider element receiving means is matched to the inclined positioning of the driver element so that no acceleration of the movable slider element is involved, in relation to the actual pressing speed. The movable slider element is thus only driven by the pressing tool and urged controlledly forwardly or outwardly in order to be able to perform the stamping or shaping work. In the rearward stroke movement in which the pressing tool has moved beyond its bottom dead center position and the two parts are moving away from each other again, the movable slider element is usually pushed back into its original position by means of a suitably designed resilient element, whereupon the procedure can be re-started. The return force required for the return movement of the slider element is usually between 2 and 10% of the actual working force and the weight of the slider element. In that respect, decisive aspects in regard to the magnitude of the pressing force are the dimensions of the surfaces for transmitting the pressure, which are referred to as sliding surfaces, the respective inclinations of the linear guide means in the slider element receiving means and the inclined positioning of the driver element as well as the co-operation of the surfaces and inclinations and the structure of the slider element itself. The pressures to be transmitted are usually between a few 100 kN and several 10,000 kN.

The linear guide means in the slider element receiving means was intended to guide the movable slider element with as little play as possible and in so doing to withstand high pressing forces and afford long service lives. To permit burr-free cutting or perforating of a workpiece a tolerance in terms of accuracy of movement of the movable slider element of a maximum of 0.02 mm is required. If that tolerance is not met, the workpieces which are cut or perforated or shaped in some other way can no longer be placed one upon the other in accurate register relationship so that errors in the basic bodywork structure occur and/or workpieces rubbing against each other means that faster corrosion occurs, the bodywork constructed is of reduced strength and possibly an increased amount of noise is generated by virtue of sheet metal parts which come loose. To avoid all those disadvantages, the requirement in particular in the automobile industry is that a wedge drive provides for extremely high levels of accuracy of movement and permanently withstands the pressing pressures required or makes them available in relation to the stamping or shaping tool.

In order to afford the required accuracy of movement here, various concepts have been developed, of which some are set forth hereinafter. By way of example slider guide means with side sliding plates and driver elements arranged at a right angle as well as a screwed cover plate for holding the slider element are known. Slider guide means of that kind admittedly withstand very high pressing forces and lateral thrust forces but they are very complicated and costly to manufacture as a high level of manual co-ordination complication and expenditure is required for matching the guide play between the elements. A further problem which has been found is inadequate protection in regard to the slider guide means falling apart, in which case the whole of the slider weight plus the rearward attachment forces act on the fastening screws of the cover plate and can very rapidly overload them. In addition such a slider guide means is comparatively large in structural size and is therefore unsuitable for constructing small sliders.

Slider guide means are also known having lateral angle bars and a driver plate arranged at a right angle. Unlike the above-discussed slider guide means the combination of the lateral sliding plates with a cover plate leads to a reduction in the amount of structural space required so that in particular it is also possible as a result to construct smaller slider sizes. It will be noted however that high forces act on the fastening screws of the angle bars and as a result provide that there is a relatively high risk of accident. In addition the complication and expenditure in terms of coordinating the co-operating elements for matching the guide play is high so that additional costs are also incurred here.

A further kind of slider guide which is used includes lateral sliding and cover plates which are inclined at an angle of 45°. They are therefore arranged approximately in a roof-shaped configuration. That makes it possible to achieve a reduction in structural width as the cover bars and the sliding plates are arranged one over the other and not one beside the other. It will be noted however that the structural space required is still very great so that it is scarcely possible to produce small sliders. In addition the traction forces occurring have a detrimental effect on the fastening screws of the cover plates, and that leads to a high level of process uncertainty.

A further known structure includes a slider guide means with a driver plate and one or two column guide means with bushes in order to hold the slider element laterally and to prevent it from dropping out. The use of a guide column with a driver plate means that admittedly only still comparatively small structural spaces are required and it is possible to achieve considerably less expensive manufacture than when using the above-mentioned solutions in the state of the art. It will be noted however that the column guide means, due to the type of structure involved, is not capable of compensating for high lateral pressures. In addition it cannot carry any heavy-weight slider elements so that those slider elements produce less pressing forces and are more susceptible to trouble in the pressing procedure.

A further kind of slider element guide arrangement is known for example from EP 1 035 965 B1. This arrangement provides for a clamping embracing relationship in respect of the slider element guide means, wherein the driver element provides a prism guide and sliding plates are inserted between the driver element and the slider element. The roof shape involved means that very high slider forces are possible, while entailing small structural spaces, and equally a very accurate guide play so that the wedge drive or the slider element guide means is stable and has a long working life. It will be noted however that manufacture of the clamping guide means, because of the expensive cutting machining operations required to achieve a precise fitting shape, is really complicated and cost-intensive as a result.

Further wedge drives are also known for example from EP 1 259 371 B1, DE 198 60 178 C1 and EP 1 197 319 B1.

All the above-described design concepts of a slider element guide means for a wedge drive have one or more sliding plates for the transmission of generally high pressing forces, and likewise suitably designed holding elements for holding the slider element in the guide provided for same. The sliding plates serve to permanently transmit the working pressures exerted by the pressing tool from the slider element receiving means and the driver element to the movable slider element and thus to guarantee the actual advancing drive effect. The holding elements serve for linearly holding the slider element on the sliding plates of the sliding element receiving means, in which case they permanently ensure the required accuracy of movement and are intended to possibly compensate for lateral thrust forces which occur in the shaping operation or in the cutting or stamping procedure.

Now the object of the present invention is to further develop a wedge drive as set forth in the classifying portion of claim 1, in such a way that a guide for the movable slider element is provided, which permits still better motional accuracy than the solutions in the state of the art, which provides for optimum conversion of the pressing force which acts into the stamping or shaping movement, which compensates for lateral thrust forces even better than the state of the art and which provides a longer service life for the wedge drive than is hitherto possible with the solutions in the state of the art. The invention further seeks to provide that a lower level of complication and expenditure is required when coordinating the wedge drives and more economical manufacture becomes a possibility.

For a wedge drive as set forth in the classifying portion of claim 1 that object is attained in that a dovetail-like or prism guide means is provided between the slider element and the slider element receiving means. For a slider element for such a wedge drive the object of the invention is attained in that the slider element has a dovetail-like or prismatically shaped side. Further developments of the invention are defined in the appendant claims.

That therefore provides a wedge drive or cotter key in which the movable slider element has a dovetail-like or prismatic side, wherein the slider element receiving means is in the form of a corresponding counterpart portion so that the slider, element with its dovetail-like or prismatic side can engage into the slider element receiving means and can be guided and held therein. The surfaces on the slider element and/or the slider element receiving means, that are respectively provided by the dovetail shape and the prism shape, bear against each other, in which case forces directed in different directions can be carried without any problem by virtue of the surfaces which are at an angle relative to each other, in the dovetail or prism shape. The dovetail shape means that, after being inserted into the correspondingly shaped receiving configuration of the slider element receiving means, the movable slider element is safeguarded against falling out or lateral displacement, without further measures.

Advantageously sliding surfaces are provided on the slider elements and/or the slider element receiving means. In a particularly preferred feature the dovetail-like or prism guide means includes at least two sliding plates arranged at an angle relative to each other. Advantageously the sliding plates of the dovetail-like or prism guide means can be L-shaped in cross-section. It is further found to be advantageous if sliding plates are provided on all surfaces, which slide against each other, of the slider element and the slider element receiving means, so that in each case at least two sliding plates arranged at an angle relative to each other are provided on the slider element and the slider element receiving means. The sliding plates which are roof-shaped or L-shaped in cross-section can advantageously be so arranged that their inner narrow sides, by virtue of the outwardly inclined oblique positioning of the sliding plates, afford an undercut configuration in the form of the above-mentioned dovetail guide configuration.

By virtue of the provision of sliding plates at two sides of the slider element and the slider element receiving means respectively at the same time, wherein they are arranged symmetrically and in an L-shape or in a roof shape so that the shape of a dovetail guide means can be achieved, it is particularly advantageously possible to dispense with further, cost-intensive, linear holding elements. Furthermore, the manufacturing costs can be markedly reduced in comparison with the solutions in the state of the art as fewer components are provided than in the state of the art without in any way adversely affecting the mode of operation of the wedge drive but rather permitting more reliable and more secure operation without the provision of holding elements, but with an extremely high level of motion accuracy.

Advantageously the dovetail-like or prism guide means includes a positively locking connection between the slider element and the slider element receiving means. The provision of such a positively locking connection affords a compact unit, by way of which even high pressing forces can be transmitted without any problem. Furthermore that prevents the slider element and the slider element receiving means from unwantedly sliding out of each other as the positively locking relationship in the region of the dovetail or prism guide means and the mechanical contact between the two portions to be joined of the slider element and the slider element receiving means provides that the forces to be transmitted are in fact transmitted by way of the surfaces which are in contact with each other and which are at an angle relative to each other and in that respect assist with holding the component parts together, by virtue of their angular positioning.

It has further proven to be advantageous if the slider element receiving means is of a protruding configuration in the region of the sliding surfaces and/or the receiving means of the sliding plates. That provides a larger surface for the sliding movement of the slider element with respect to the slider element receiving means so that very good transmission of the pressing forces by way of those enlarged receiving surfaces is possible.

Advantageously the sliding plates can be releasably fixed to the slider element receiving means and/or the slider element, in particular by fixing screws. The releasability of the sliding plates from the slider element receiving means and the slider element respectively means that it is possible to replace them when wear occurs. It will be appreciated that in principle it would also be possible to equip the corresponding sliding surfaces of the slider element receiving means and the slider element in such a way that they can slide against each other, without the interposition of sliding plates. In that case however in the event of wear it would be necessary to replace the slider element receiving means and the slider element themselves so that it has proven to be less expensive and in operation easier in terms of handling if the arrangement has releasable sliding plates as then replacement thereof is possible quickly and without any problem.

The side of the slider element, which is of a dovetail-like or prismatic shape, advantageously has support surfaces as the sliding surfaces, in particular for the attachment of sliding plates. It has proven to be particularly advantageous in that respect to provide in each case two sliding plates which are arranged at an angle relative to each other as here it is possible to avoid arduous adjustment of four individual sliding plates which are arranged at an angle relative to each other. It is only necessary to implement adjustment at a respective one of the support surfaces for a respective sliding plate so that it is possible to rapidly change sliding plates.

Advantageously a wedge guide means is provided between the slider element and the driver element. That arrangement provides that very high forces can be carried while involving a comparatively small structural space, while at the same time accurate stable guidance for the slider element on the driver element upon movement thereof is possible.

Advantageously the wedge guide means includes two sliding plates arranged at an angle relative to each other. Those sliding plates advantageously comprise a material which assists with the sliding movement, in particular bronze with a solid lubricant. The provision of the sliding plates which are fastened in particular replaceably to the driver and/or slider element provides in a simple fashion that the plates can be replaced in the event of wear while in operation providing for optimum sliding movement of the surfaces, which are joined to each other, of the driver element and the slider element.

It has further proven to be advantageous if the dovetail-like or prism guide means and the wedge guide means are provided at an angle relative to each other on the slider element. The arrangement involving a plurality of angles relative to each other means that it is possible to reduce in particular the structural size of the wedge drive, thus affording a compact unit which can be used even with constricted space conditions within a pressing tool.

It is further found to be advantageous if the dovetail-like or prism guide means and the wedge guide means are provided at two mutually adjacent sides of the slider element. That makes it possible to improve the accuracy of movement but at the same time primarily also it is possible to reduce the structural size in comparison with the solutions in the state of the art which usually involve operative engagement on a driver element and operative engagement on the slider element receiving means at two mutually oppositely disposed sides of the slider element.

The slider element can have a third side adjacent to the other two sides, with a receiving means for receiving a processing tool. In that case the third side advantageously has at least two undercut configurations and/or grooves for the insertion of protruding elements of a receiving means for receiving a processing tool. The provision of such a separate receiving means for receiving a processing tool such as for example a perforating punch leads to simple replacement of the tool without any problem as it is only necessary for the receiving means to be removed from the third side of the slider element and replaced by another receiving means which for example carries a different tool. This totally eliminates a tedious procedure of screwing on and unscrewing the processing tool itself, possibly with drilling of further holes in the slider element. The provision of undercut configurations and/or grooves at the third side of the slider element means that the receiving means can be inserted there for example by being pushed into place, in which case further fixing is not even necessary as optimum transmission of force is already guaranteed in particular by virtue of the undercut configurations, due to the positively locking connection afforded thereby.

The third side of the slider element can also be provided with at least one wedge surface, in which case the receiving means then preferably has a corresponding wedge surface to provide a positively locking connection between the slider element and the receiving means for the processing tool. Lateral thrust forces can be carried thereby and the transmission of force can be optimized.

The mode of operation of a wedge drive usually comprises the working stroke and the return motion. During the working stroke the slider element is moved outwardly between the sliding surfaces, which are arranged in wedge form, of the driver element and the slider element receiving means, in which case the slider element receiving means and the driver element are movable towards each other perpendicularly, driven by the pressing stroke. The pressing force applied by the pressing tool corresponds in that respect to the counteracting force which the wedge drive applies for the work done by it, for example cutting, perforating or post-shaping a bodywork portion, wherein that is distributed to the sliding surfaces in dependence on the respective angular position of the individual sliding surfaces relative to each other. Due to the provision of sliding surfaces which are arranged at an angle relative to each other and which are arranged in a roof shape or a prism shape relative to each other, the movable slider element is automatically centered between the slider element receiving means and the driver element or on the sliding surfaces thereof. That can provide a very high level of motion accuracy and lateral guidance for the slider element, while manufacturing tolerances or other inaccuracies caused by manufacture can be compensated and thus no longer have an adverse influence.

In the return motion of the slider element, referred to as the rearward stroke, in which the pressing tool moves away from each other and thus the slider element receiving means is moved away from the driver element, the slider element is retracted into the region between the slider element receiving means and the driver element. The dovetail shape of the guide means between the slider element receiving means and the slider element once again permits self-centering linear guidance for the slider element. The forces acting on the slider element in the rearward stroke or in the return motion are restricted only by the weight of the slider element and the retraction forces acting on the slider element receiving means, the slider element and the driver element, as the pressing tool moves apart. The sliding surfaces of the slider element and the slider guide element, which run against each other in that situation, can be reduced in their dimensions in relation to the sliding surfaces which run against each other in the working stroke, so that the above-mentioned L-shape for the sliding surfaces on the dovetail guide means is found to be highly suitable in that respect.

In the case of a suspended upper part slider or wedge drive the weight of the slider element acts on the surfaces of the slider element receiving means, which bear in positively locking relationship against the slider element sliding surfaces of the dovetail guide arrangement, and exerts a downwardly directed spreading force on those surfaces of the sliding element receiving means. By virtue of the positively locking shoulder support for the slider element with respect to the slider element receiving means however those lateral thrust forces are compensated so that permanent and stable fixing of the slider element to the slider element receiving means and the sliding plates on the slider element and the slider element receiving means is possible. Therefore the fixing screws of the sliding plates are not subject to any forces such as to damage them, in particular tensile forces. As guidance for the slider element along the slider element receiving means by virtue of the dovetail guide arrangement is possible with a high degree of precision and without being sensitive to lateral thrust forces as well as being inexpensive to manufacture, without the provision of further components in the form of a linear guide means, the result is a compact wedge drive with a very high level of accuracy of motion, which is also insensitive in relation to manufacturing tolerances. As clamp guides or further elements are no longer required, not only can the costs be reduced in comparison with the solutions in the state of the art, but the process reliability is also increased and a possible risk of accident reduced. As the slider element only needs to be pushed into the slider element receiving means, assembly of the wedge drive is simplified in comparison with the solutions in the state of the art. It is possible to dispense with a cost-intensive operation of grinding in the guide elements as the prism guides or dovetail guide of the slider element receiving means, the slider element and the driver element are insensitive in relation to tolerances in manufacture. The self-centering effect achieved by the prism guides also leads to a very high level of accuracy in terms of motion in regard to carrying lateral thrust forces. By virtue of the compact structure of the wedge drive it is not only suitable for a small structural space available within a pressing tool, but, as will be appreciated, it is also suitable for uses involving larger dimensions. The prism guide means or the dovetail-like guide means provided between the slider element and the slider element receiving means can thus be used to equip small, medium and large-format wedge drives, thus affording a large range of uses.

BRIEF DESCRIPTION OF THE DRAWINGS

Embodiments by way of example will be described in greater detail hereinafter to describe the invention more fully, with reference to the drawings in which.

DETAILED DESCRIPTION OF THE PREFERRED EMBODIMENT

Figure 1:
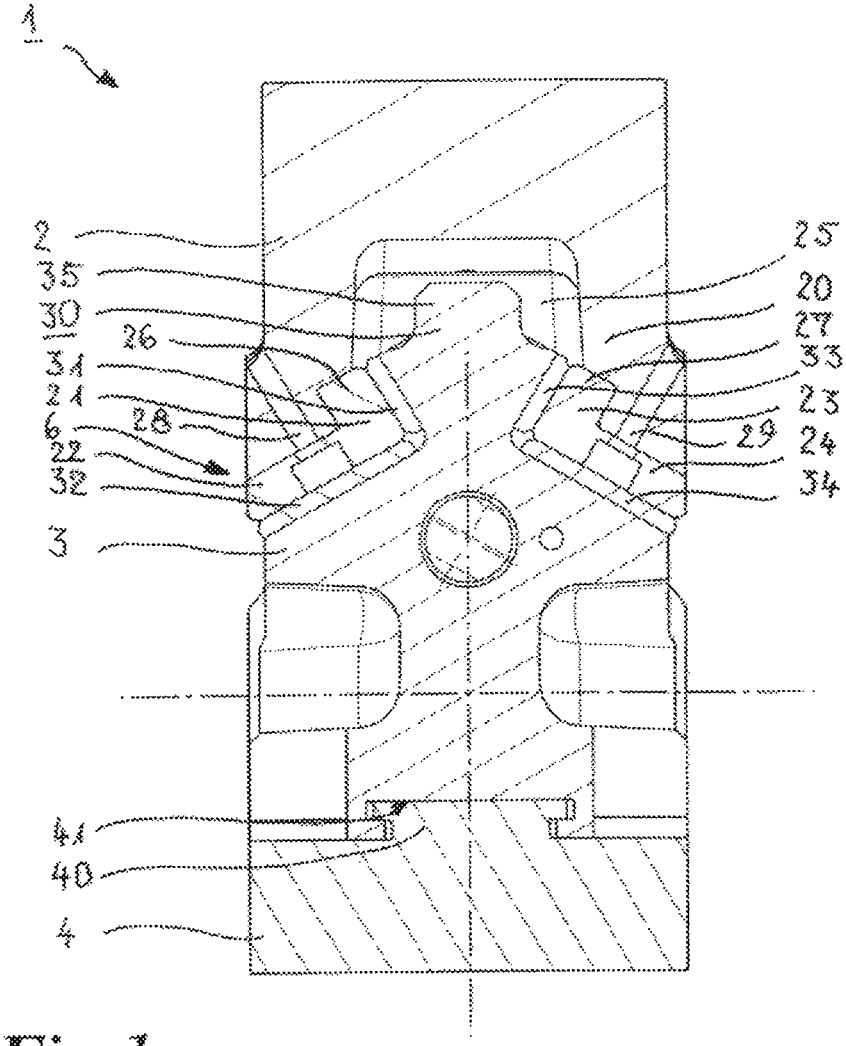
FIG. 1 shows a vertical cross-sectional view through a first embodiment of a wedge drive according to the invention with dovetail-like guide means.

FIG. 1 shows a sectional view of a wedge drive 1 or cotter key comprising a slider element receiving means 2, a slider element 3 and a receiving means 4 for receiving a processing tool. A driver element connected to the slider element 3 is not visible in FIG. 1 but can be found in the perspective view in FIG. 4.

The slider element and the slider element receiving means are connected together by way of a dovetail-like or prism guide means 6. In this case the slider element 3 has a portion 30 of a dovetail-like configuration. It includes two sliding surfaces 31, 32, 33, 34 which are respectively disposed at an angle to each other on both sides. In this arrangement the two sliding surfaces 31 and 33 are smaller than the two sliding surfaces 32 and 34. The reason for this is that, in a working stroke, the pressing forces exerted by a pressing tool in which the wedge drive is arranged are transmitted from the slider receiving means to the slider element by way of the sliding surfaces 32, 34. In a return motion or a rearward stroke movement of the pressing tool the slider element is retracted by way of the two sliding surfaces 31, 33, in which case a very much lesser force is exerted on the slider element so that those smaller dimensions for the sliding surfaces are adequate.

The slider element receiving means 2 has a portion 20 which is of a correspondingly opposite and equal configuration and which includes corresponding sliding surfaces 21 through 24 which each bear in positively locking relationship against the sliding surfaces 31 through 34. In addition the portion 30 of a dovetail-like configuration engages with a protruding portion 35 into a corresponding recess 25 in positively locking relationship in the slider element receiving means 2. The protruding portion 35 can only extend over a part of the longitudinal extent of the slider element and the slider element receiving means respectively. In principle it is also possible not to provide such a protruding portion, in which case however the hold of the slider element and the slider element receiving means to each other is markedly improved by such a protruding portion 35 which engages in positively locking relationship into a corresponding recess 25 of the slider element receiving means.

As can further be seen from FIG. 1, sliding plates are provided on the slider element receiving means and the slider element to form the corresponding sliding surfaces 21 through 24, and 31 through 34 respectively. The sliding plates 26, 27 on the slider element receiving means 2 are of an L-shaped cross-section in cross-section, whereas individual flat sliding plates 36, 37, 38, 39 are attached to the corresponding surfaces of the slider element, as can be better seen from FIG. 3. The L-shaped sliding plates 26, 27 are fixed to the slider element receiving means by fixing screws 28, 29. The sliding plates 36 through 39 are also fixed to the slider element by corresponding fixing screws, although these are not shown in FIG. 1.

The provision of such a releasable fixing for the sliding plates to the slider element receiving means and the slider element respectively permits the sliding plates to be replaced without any problem, when wear is involved. The fixing screws are arranged in sunk relationship in the sliding plates so that the sliding movement of the sliding surfaces against each other is not impeded by the provision of the fixing screws.

As can be clearly seen in particular from the cross-sectional view in FIG. 1 the slider element receiving means protrudes outwardly in the region of the dovetail-like guide means to provide a sufficiently large sliding surface 22, 24 for support and sliding movement on the slider element 3.

As can be further seen from FIG. 1 the receiving means 4, for receiving a processing tool, is provided with a T-shaped protrusion 40 and the slider element 3 is provided with a corresponding T-shaped groove 41. By virtue of that arrangement the receiving means for the processing tool can be easily pushed into the T-shaped groove 41, whereby simple fixing and a secure hold on the slider element is possible. Instead of a T-shaped groove and a T-shaped protrusion, it is also possible to provide a wedge shape with corresponding grooves and protrusions in that region so that in addition it is also possible to provide a centering action and to provide for carrying lateral thrust forces in that region. As however there is no provision for movement of the slider element with respect to the receiving means, in most cases it is sufficient to provide the T-shaped groove and the T-shaped protrusion.

Figure 2:
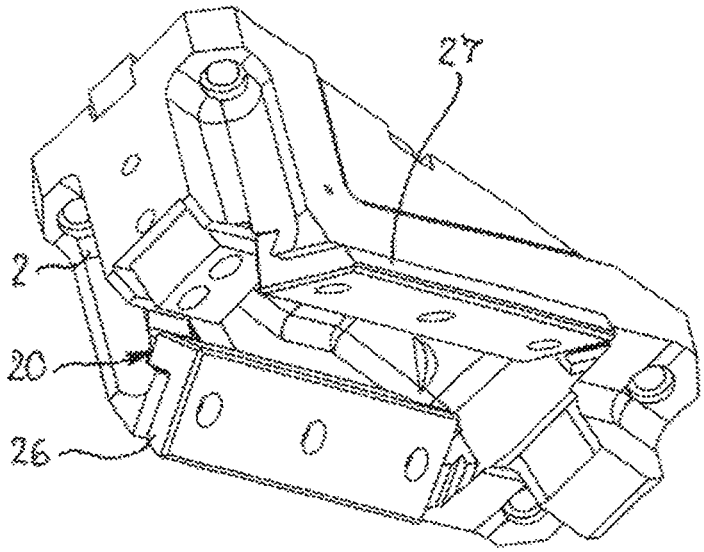
FIG. 2 shows a perspective view of the slider element receiving means and the slider element of the wedge drive of FIG. 1.
Figure 2:
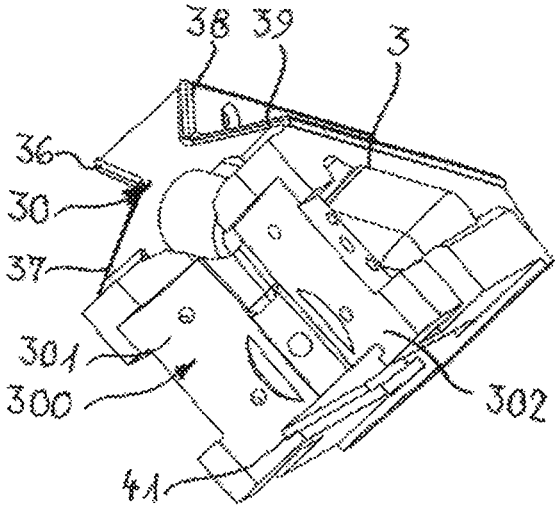

FIG. 2 shows a perspective view of the detail of the slider element receiving means and the slider element, viewed inclinedly from below. The two are shown separately so that it is possible to view the sliding plates 26, 27 of the slider element receiving means 2 and the dovetail-shaped portion 20 of the slider element receiving means. In addition it is also possible to clearly see the portion 30 of the slider element, which is of a dovetail-like configuration, and also the sliding plates secured thereto, the fixing thereof by screws also being indicated. As can be even better seen from the perspective exploded view in FIG. 3 the respective sliding plates are fixed to the slider element receiving means and the slider element respectively by three fixing screws. The sliding plates have corresponding bores for receiving the fixing screws.

Figure 3:
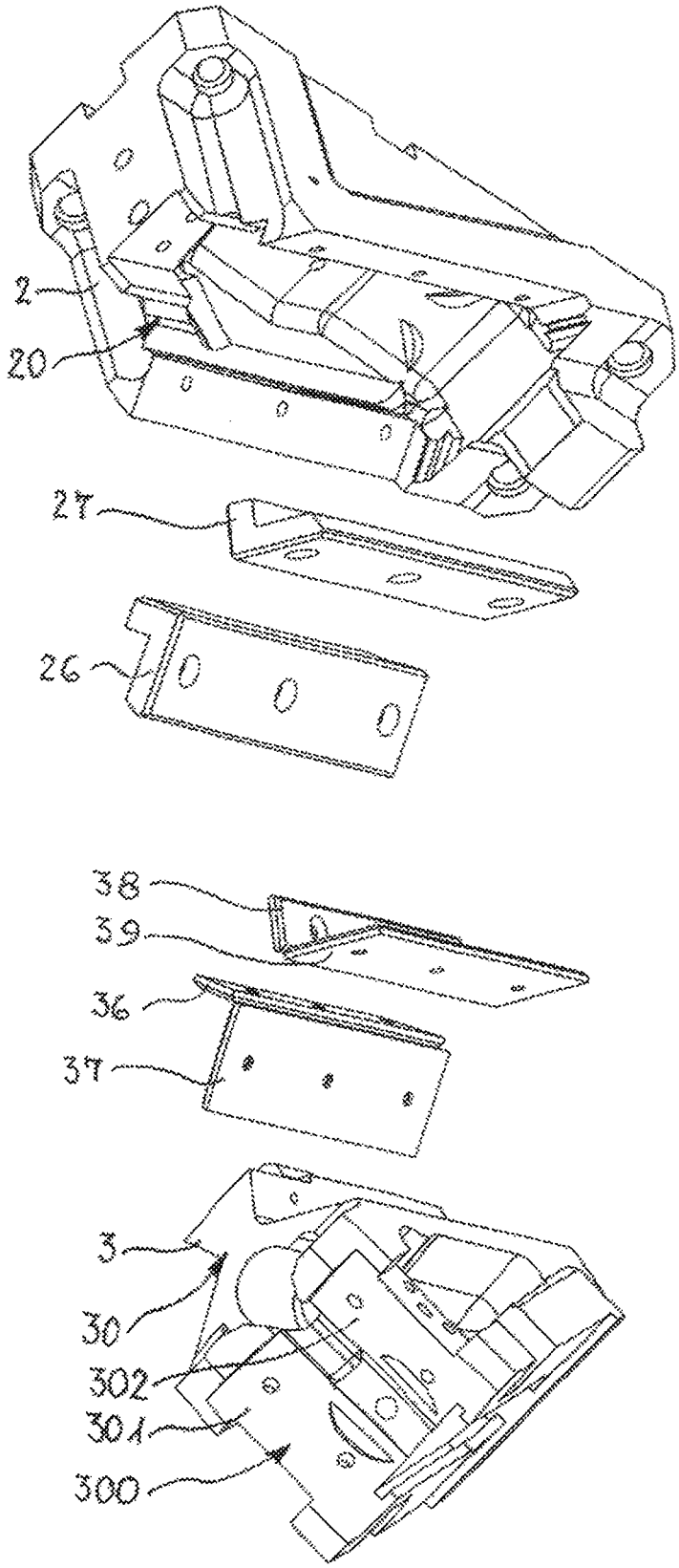
FIG. 3 shows a perspective exploded view of the slider element receiving means and the slider element of FIG. 2.
Figure 4:
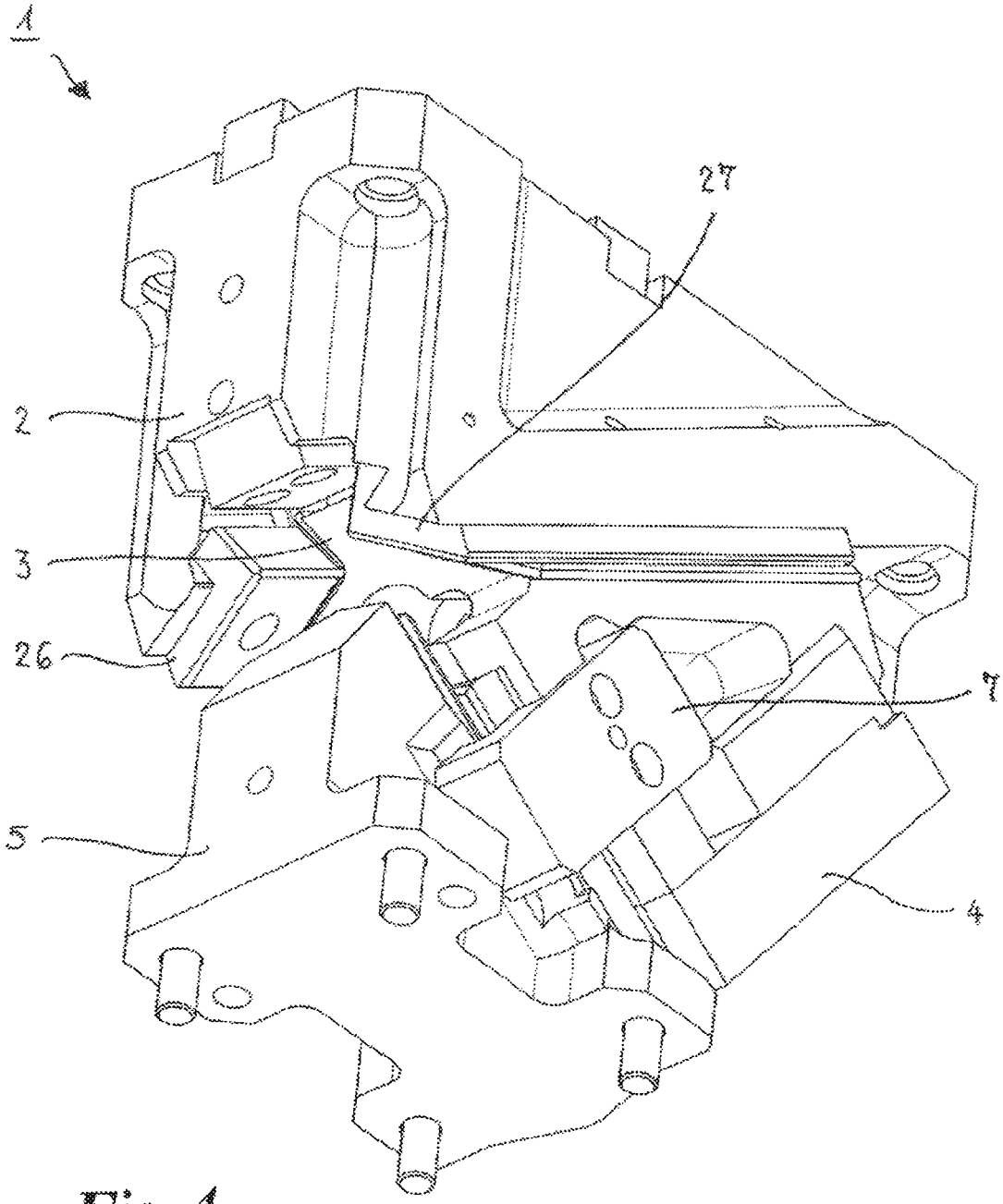
FIG. 4 shows a perspective view of a second embodiment of a wedge drive according to the invention with dovetail-like guide means between the slider element and the slider element receiving means.

FIGS. 2 and 3 also show a wedge-shaped receiving surface 300 for connection to the driver element 5 which is to be seen in FIG. 4. The wedge-shaped receiving surface 300 is divided into two and has two sliding surfaces 301, 302, to which respective sliding plates are attached, although the sliding plates are not to be seen in FIGS. 2 and 3. The wedge-shaped receiving surface 300 is at an angle both to the dovetail-shaped portion 30 and also the side with the T-shaped groove 41 for receiving the receiving means for the processing tool, thus affording an extremely compact structural shape for the slider element, substantially without unused side surfaces. That can also be seen in particular from the perspective view of the assembled wedge drive 1 shown in FIG. 4, in which the slider element receiving means, the slider element, the driver element and the receiving means for the processing tool are assembled. It can also be seen in that respect that the driver element and the slider element are connected together by positively acting return claps 7. They serve for better entrainment of the slider element in the rearward stroke movement of the pressing tool. The positively acting return clamps 7 engage both on the slider element and also the driver element, in openings, recesses or grooves provided there.

Figure 5:
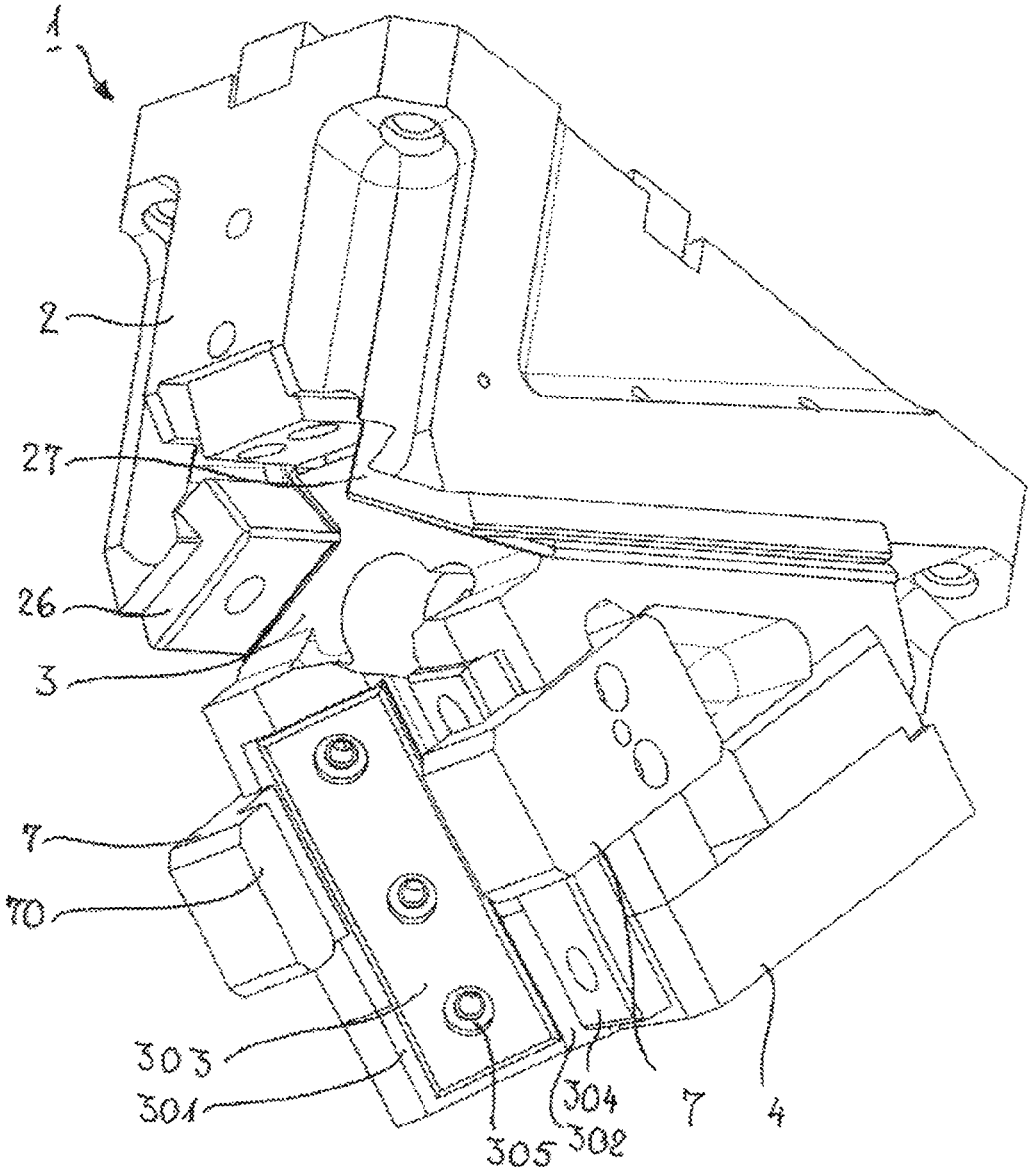
FIG. 5 shows a perspective view of the wedge drive of FIG. 4 without a driver element.

It can be clearly seen from FIG. 5 that the positively acting return clamps 7, for that purpose, have protruding portions 70 which can engage into corresponding grooves in the driver element. It can also be seen from FIG. 5 that sliding plates 303, 304 are fixed on the sliding surfaces 301, 302 by way of fixing screws 305.

Figure 6:
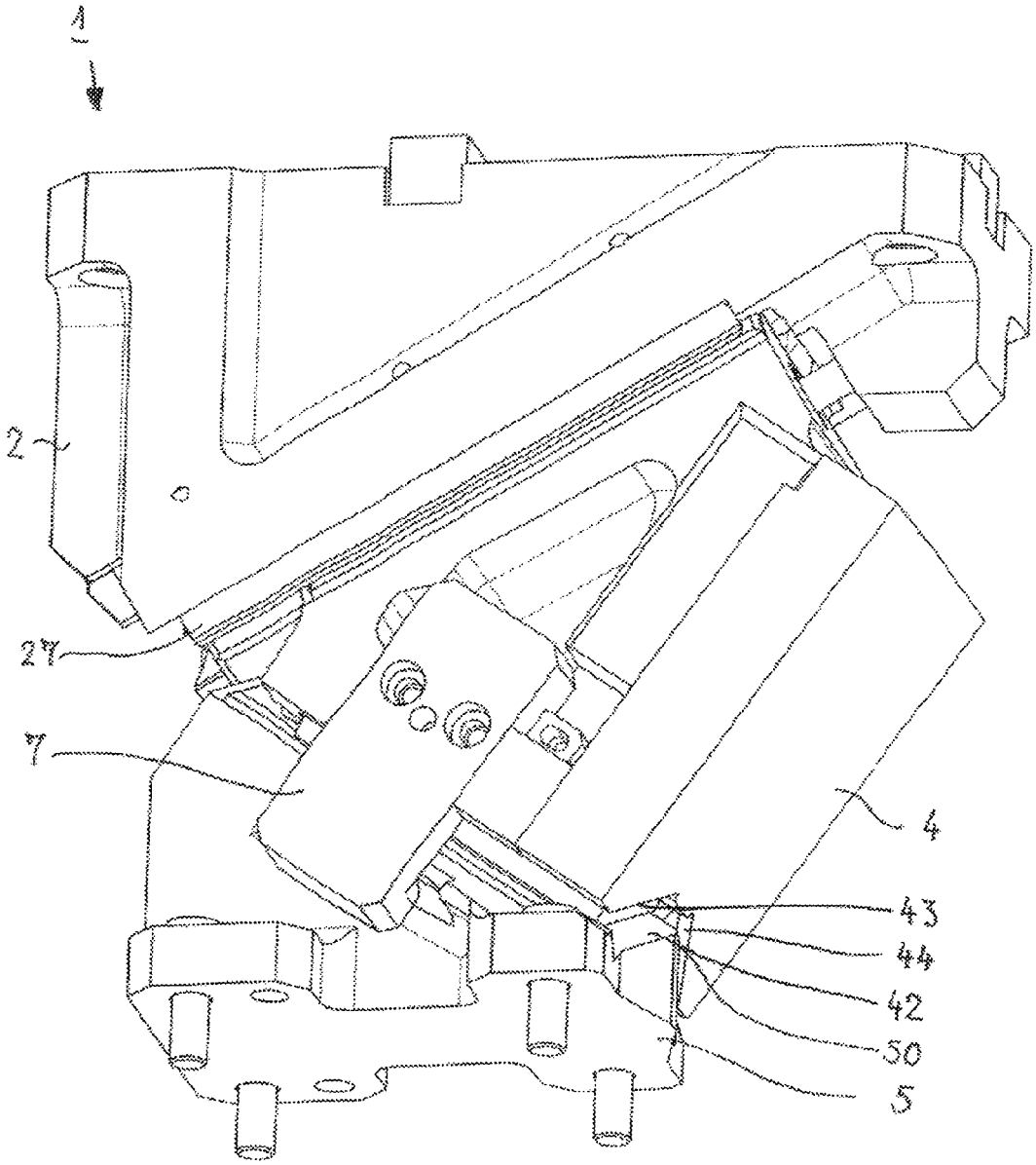
FIG. 6 shows a perspective side view of the wedge drive of FIG. 4.

The perspective view of the wedge drive 1 in FIG. 6, which is turned through 90° relative to the view in FIG. 4, shows a view on to the receiving means 4 for receiving a processing tool. It will be seen in that respect that the receiving means 4 is provided with a corresponding wedge surface comprising two sliding surfaces 43, 44 which can slide on a corresponding wedge portion 50 of the driver element 5.

Figure 7:
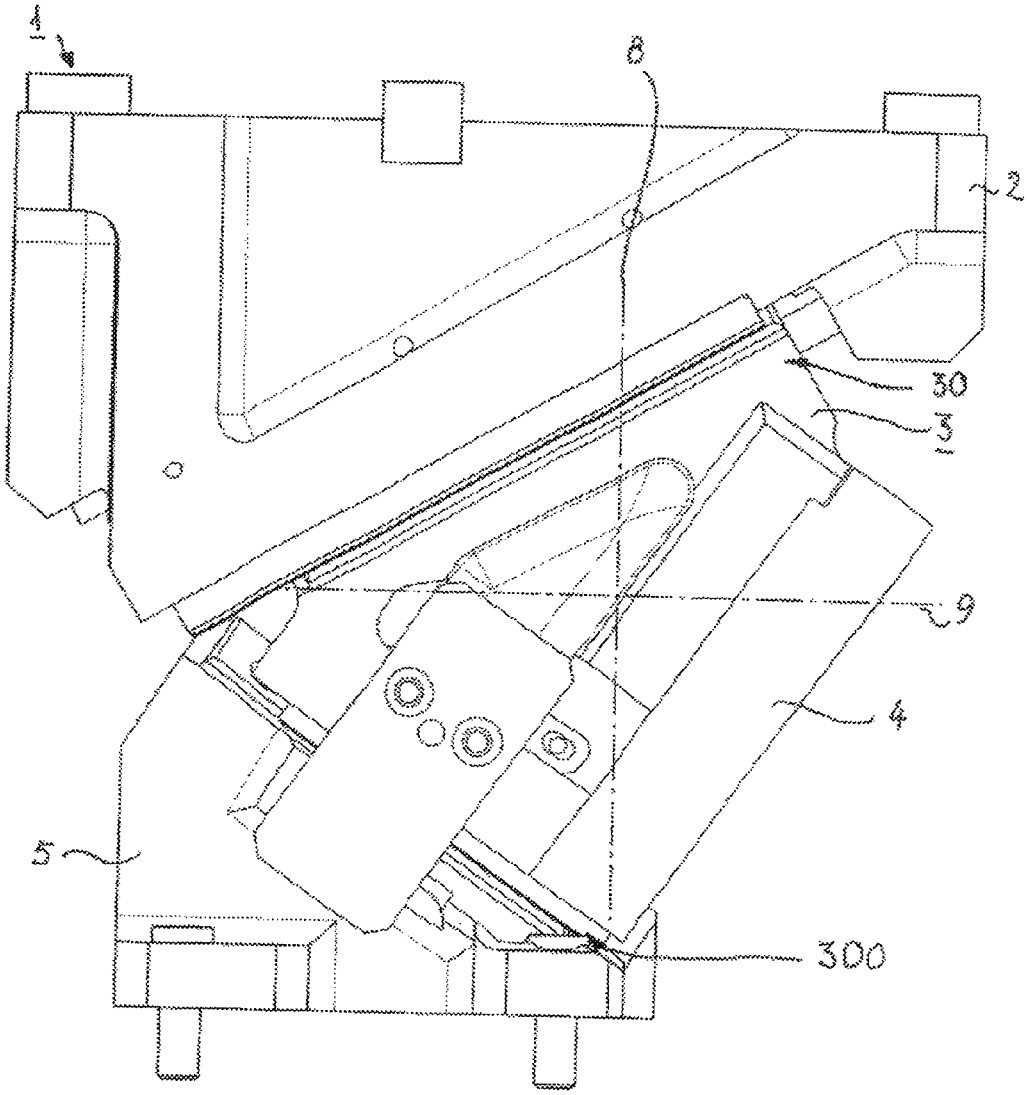
FIG. 7 shows a lateral plan view of the wedge drive of FIG. 4.

It can be even better seen from the side view of the wedge drive 1 shown in FIG. 7 that the portion 30 of a dovetail-like configuration, the wedge-shaped receiving surface 300 and the third side with the T-shaped groove 41 for receiving the receiving means 4 for the processing tool of the slider element 3 are respectively arranged at an angle relative to each other. Each of the sides of the slider element is also at an angle relative to the perpendicular or the horizontal respectively which are indicated by broken lines 8, 9 in FIG. 7. Here once again it is possible to clearly see the extremely compact structural form of the wedge drive.

Figure 8:
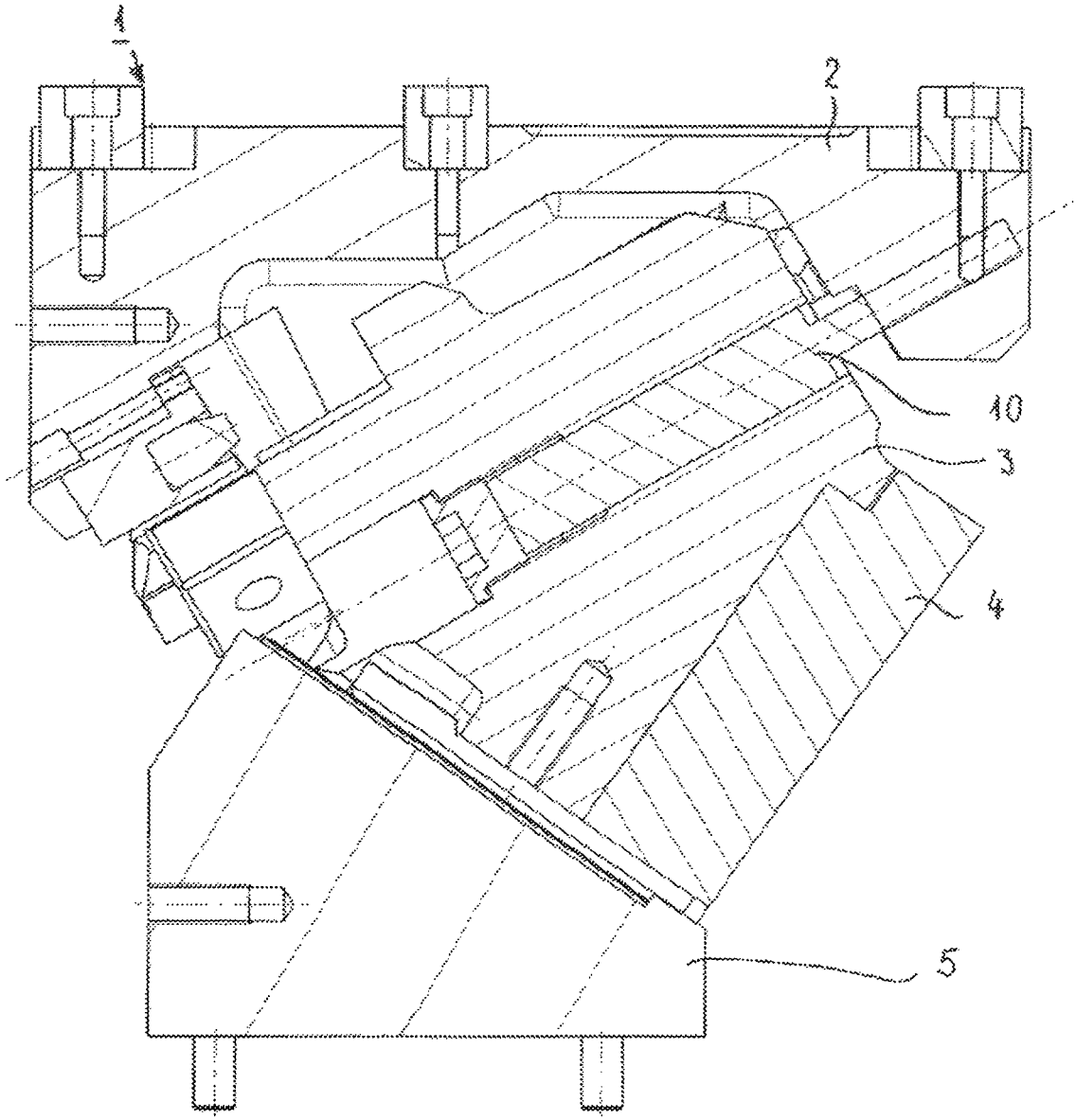
FIG. 8 shows a sectional side view of the wedge drive of FIG. 4.

The corresponding side view in section of the wedge drive 1 shown in FIG. 8 additionally shows a spring element 10 in the form of a gas pressure spring. It serves to retract the slider element back into its starting position in the rearward stroke movement of the pressing tool. That facilitates the retraction movement of the slider element in the rearward stroke movement so that a working stroke can be more rapidly performed again. Depending on the respective configuration of the wedge drive however it would even be possible to omit such a spring element, in particular when positively acting return devices of a special design in the form of the positively acting return clamps 7, for example in the form of positively acting returning devices with rolling frictional elements, are provided.

Figure 9:
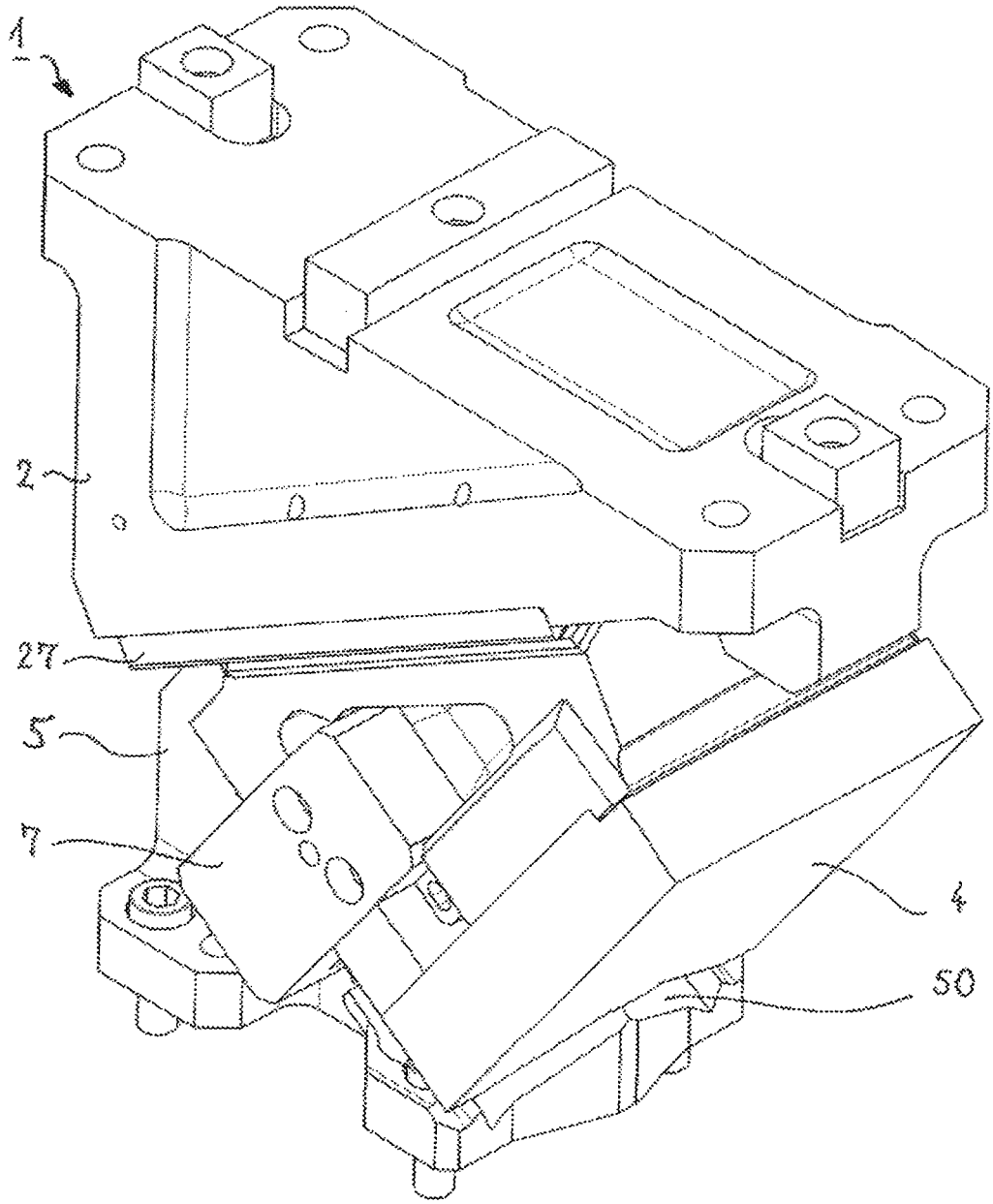
FIG. 9 shows a perspective view inclinedly from above of the wedge drive shown in FIG. 4 with fitted receiving means for a processing tool.

It can also be clearly seen once again from the perspective view on to the wedge drive 1 of FIG. 9 that the slider element is of an extremely compact configuration by virtue of a suitable arrangement of its three sides with a portion of a dovetail-like configuration for engagement into the slider element receiving means, the T-shaped groove for receiving the receiving means 4 for the processing tool and the wedge-shaped receiving surface for co-operation with the driver element 5.

Figure 10:
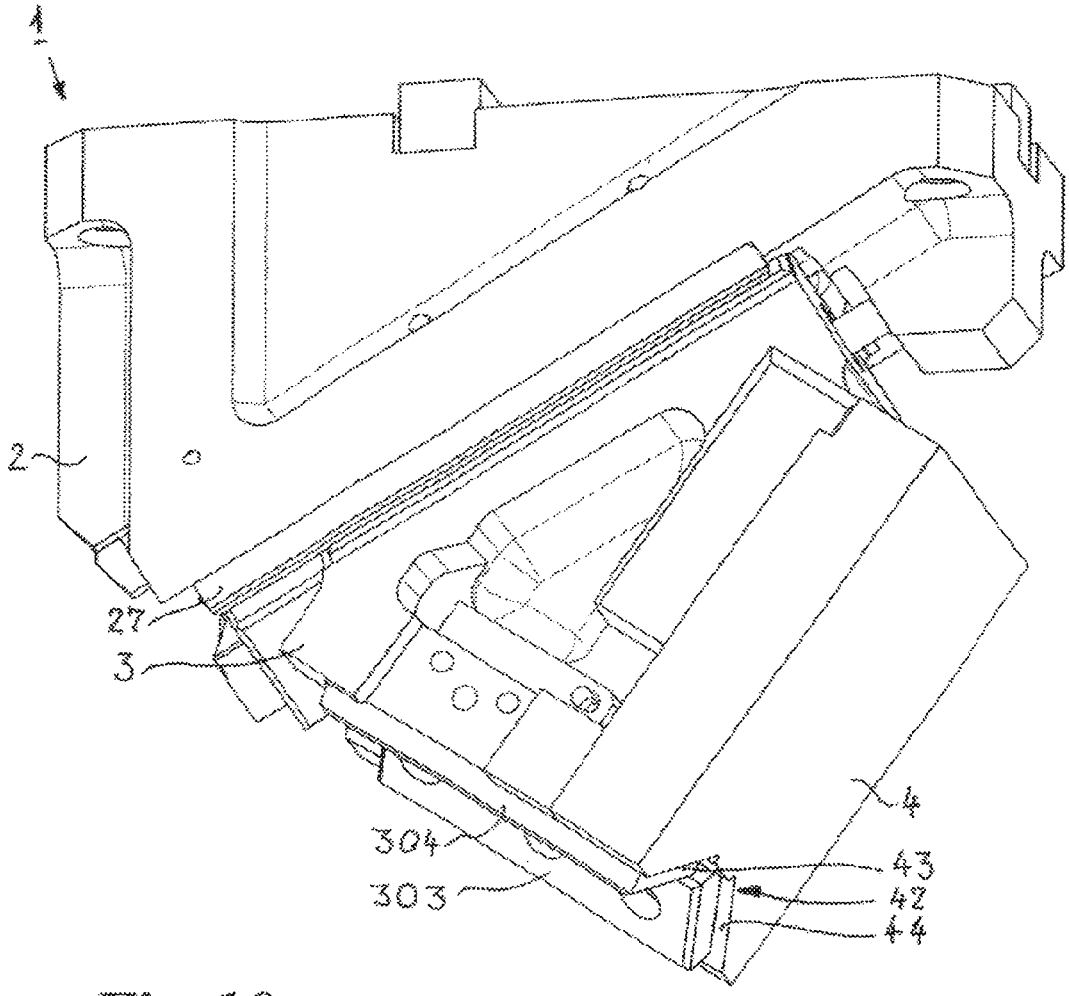
FIG. 10 shows a perspective view of the wedge drive provided with a receiving means for a processing tool as shown in FIG. 9 with the driver element removed.

The perspective view of the wedge drive 1 from below with the driver element 5 removed, as shown in FIG. 10, shows that the sliding plates 303, 304 can be of such a length that they also engage under the sliding surfaces 43, 44 of the wedge surface 42 of the receiving means 4 for the processing tool, that is to say no further sliding plates are provided here, but only the sliding plates 303, 304, so that this arrangement provides a unitary surface for co-operation with the corresponding wedge portion 50 of the driver element 5.

Figure 11:
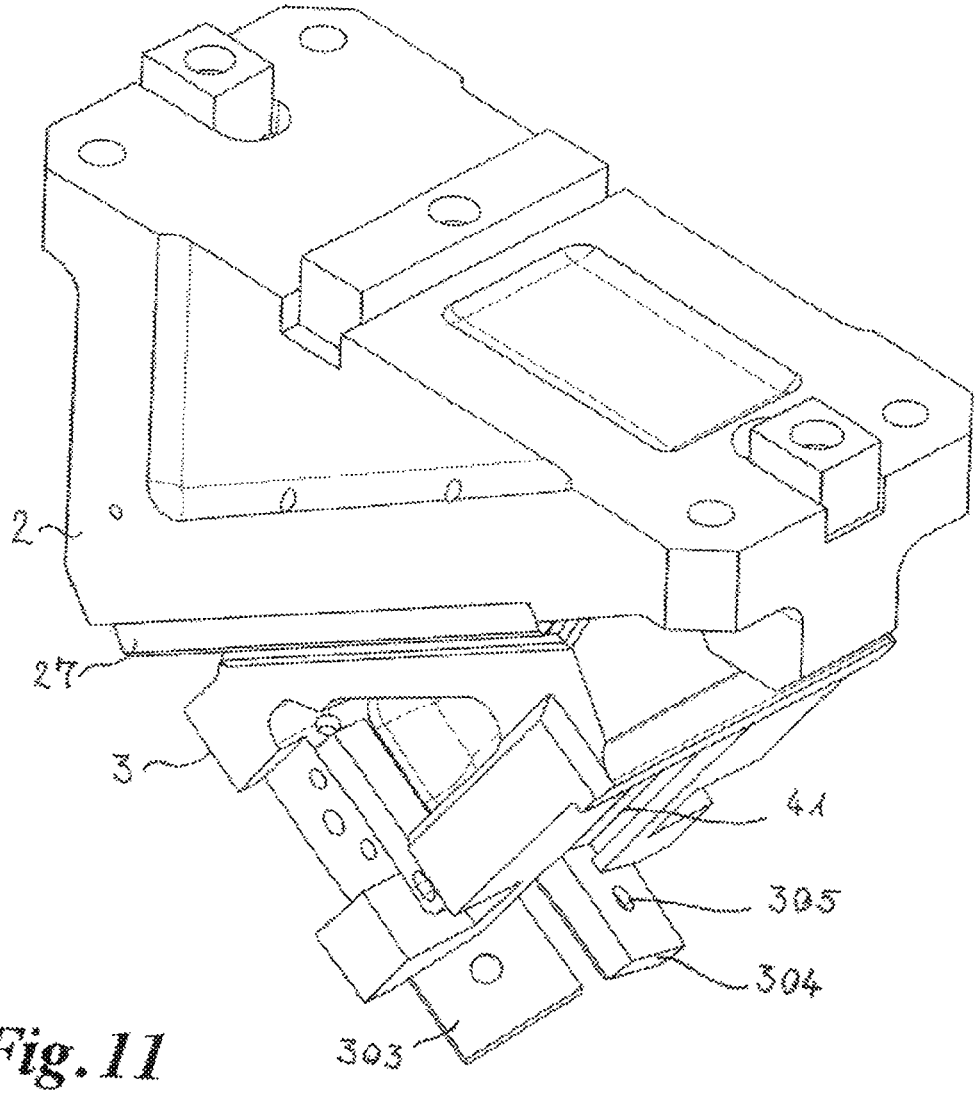
FIG. 11 shows a perspective view of the wedge drive of FIG. 10 with the receiving means for a processing tool removed and with the driver element removed.

The sliding plates 303, 304, with the receiving means for the processing tool removed, can be seen once again from the perspective view of the wedge drive 1 from above as shown in FIG. 11. It is also evident in this respect that suitable fixing to the receiving means for the processing tool is afforded by the provision of a bore 305 in the sliding plates 303, 304 and a corresponding fixing screw which however is not shown in FIG. 11. By way thereof, fixing of the receiving means 4 for the processing tool to the slider element can be still further improved and an even more stable unit is afforded.

The above-mentioned sliding plates on the slider element and the driver element as well as the slider element receiving means preferably comprise bronze with a solid lubricant to permit particularly good sliding motion of the corresponding pairs of sliding components against each other. It will be appreciated that in principle it is also possible to use other materials for the sliding plates, wherein a low level of friction in the surfaces which slide against each other means that particularly optimum movement of the slider element within the wedge drive is possible in the working stroke and the rearward stroke of the pressing tool in which the wedge drive is disposed.

Besides the embodiments described hereinbefore and illustrated in the Figures for wedge drives having a dovetail-like or prism guide means, it is also possible to form numerous further embodiments in which dovetail-shaped sliding surfaces are provided between the slider element receiving means and the slider element or prism guides are provided between the slider element and the driver element and the slider element receiving means and the slider element. That markedly improves the respective accuracy of movement of the slider element between the slider element receiving means and the driver element in comparison with the state of the art, lateral thrust forces are absorbed and manufacturing tolerances on the slider element receiving means, the slider element and the guide element are compensated. The provision of only one dovetail-like or prism guide means between the slider element receiving means and the slider element makes it possible to save on further components which assist with the guidance action, and thus manufacture of the wedge drive can be markedly less expensive than in the state of the art.

LIST OF REFERENCES

1 wedge drive
2 slider element receiving means
3 slider element
4 receiving means for processing tool
5 driver element
6 dovetail-like or prism guide means
7 positively acting return clamp
8 vertical line
9 horizontal line
10 spring element (gas pressure spring)
20 portion
21 sliding surface
22 sliding surface
23 sliding surface
24 sliding surface
25 recess
26 L-shaped sliding plate
27 L-shaped sliding plate
28 fixing screw
29 fixing screw
30 portion of dovetail-like configuration
31 sliding surface
32 sliding surface
33 sliding surface
34 sliding surface
35 protruding portion
36 sliding plate
37 sliding plate
38 sliding plate
39 sliding plate
40 T-shaped protrusion
41 T-shaped groove
42 wedge surface
43 sliding surface
44 sliding surface
50 wedge portion
70 protruding portion
300 wedge-shaped receiving surface
301 sliding surface
302 sliding surface
303 sliding surface
304 sliding plate
305 bore

What is claimed is:

1. A wedge drive comprising a slider element receiving component, a movable slider element and a driver element, wherein a dovetail shaped guide is provided between the slider element and the slider element receiving component, wherein the slider element comprises an upper portion and a lower portion connected at a narrowing neck portion to form a dovetail shaped configuration, the slider element including sliding surfaces comprising a first sliding surface associated with the lower portion at a first angle inclined downwardly relative to an axis perpendicular to a plane along the narrowing neck portion and a second sliding surface associated with the upper portion at a second angle inclined upwardly relative to the axis, by way of which forces are transmitted from the slider element receiving component to the slider element in a working stroke during which the slider element is moved outwardly between the driver element and the slider element receiving component, and the slider element receiving component has a corresponding counterpart portion including sliding surfaces facing the sliding surfaces associated with the slider element, wherein the dovetail shaped configuration and the counterpart portion together form the dovetail shaped guide, and the dovetail shaped configuration of the slider element extends between outwardly protruding portions of the corresponding counterpart portion of the slider element receiving component, wherein said protruding portions comprise the sliding surfaces which face the sliding surfaces associated with the slider element, by way of which forces are transmitted from the slider element receiving component to the slider element in the working stroke.

2. A wedge drive as set forth in claim 1 wherein the dovetail shaped guide includes at least two sliding plates arranged at an angle relative to each other and providing the sliding surfaces.

3. A wedge drive as set forth in claim 2, wherein the sliding plates of the dovetail shaped guide are generally L-shaped in cross-section such that the first sliding surface and the second sliding surface form a corner of the L-shaped cross-section, the corner abutting the narrowing neck portion.

4. A wedge drive as set forth in claim 1, wherein two sliding plates arranged at an angle to each other are provided on each the slider element receiving component and the slider element.

5. A wedge drive as set forth in claim 1, wherein the dovetail shaped guide includes a positively locking connection between the slider element and the slider element receiving component.

6. A wedge drive as set forth in claim 2, wherein the sliding plates are releasably fixed to the slider element receiving component and the slider element by fixing screws.

7. A wedge drive as set forth in claim 1, wherein a wedge guide is provided between the slider element and the driver element.

8. A wedge drive as set forth in claim 7, wherein the wedge guide includes two sliding plates arranged at an angle relative to each other.

9. A wedge drive as set forth in claim 7, wherein the dovetail shaped guide and the wedge guide are provided at an angle relative to each other on the slider element.

10. A wedge drive as set forth in claim 7, wherein the dovetail shaped guide and the wedge guide are provided at two mutually adjacent sides of the slider element.

11. A slider element for a wedge drive the slider element being arranged between a slider element receiving component and a driver element, wherein the slider element comprises an upper portion and a lower portion connected at a narrowing neck portion to form a dovetail shaped side, the slider element including sliding surfaces comprising a first sliding surface associated with the lower portion at a first angle inclined downwardly relative to an axis perpendicular to a plane along the narrowing neck portion and a second sliding surface associated with the upper portion at a second angle inclined upwardly relative to the axis, wherein the sliding surfaces transmit forces from the slider element receiving component to the slider element in a working stroke during which the slider element is moved outwardly between the slider element receiving component and the driver element, and wherein the sliding surfaces associated with the slider element transmit forces from the slider element receiving component to the slider element in a rearward stroke during which the slider element receiving component is moved away from the driver element.

12. A slider element as set forth in claim 11, wherein the dovetail shaped side has contact surfaces as the sliding surfaces.

13. A slider element as set forth in claim 11, wherein the dovetail shaped side has two respective sliding plates arranged at an angle relative to each other and providing the sliding surfaces.

14. A slider element as set forth in claim 11, wherein provided in adjacent relationship with the first dovetail shaped side is a second side having at least one wedge guide surface for connection to the driver element.

15. A slider element as set forth in claim 14 wherein the at least one wedge guide surface comprises at least one sliding plate.

16. A slider element as set forth in claim 11, wherein the slider element has a third side adjacent to the other two sides, having a receiving portion for receiving a processing tool.

17. A slider element as set forth in claim 16, wherein the third side has at least two undercut configurations for the insertion of protruding elements of a receiving portion for receiving a processing tool.

18. A slider element as set forth in claim 16, wherein the third side is provided with at least one wedge surface.

19. A wedge drive as set forth in claim 1, wherein the first sliding surface and the second sliding surface are on the upper portion and the lower portion respectively.

20. A wedge drive as set forth in the claim 19, wherein the first sliding surface and the second sliding surface are provided by plates attached to the upper portion and the lower portion respectively.

21. A wedge drive as set forth in claim 1, wherein the sliding surfaces associated with the slider element transmit forces from the slider element receiving component to the slider element in a rearward stroke during which the slider element receiving component is moved away from the driver element and the sliding surfaces by way of which forces are transmitted in the working stroke are bigger than the sliding surfaces by way of which forces are transmitted in the rearward stroke.

22. A wedge drive as set forth in claim 21, wherein the protruding portions of the slider element receiving component comprise sliding surfaces that face the sliding surfaces associated with the slider element by way of which forces are transmitted in the rearward stroke.

23. A wedge drive as set forth in claim 1, wherein the first angle is equal to the second angle.

24. A wedge drive as set forth in claim 2, wherein the sliding plates are releasably fixed to the slider element receiving component and the slider element.

25. A wedge drive as set forth in claim 1, wherein the first sliding surface and the second sliding surface are on the upper portion and the lower portion respectively.

26. A wedge drive as set forth in the claim 25, wherein the first sliding surface and the second sliding surface are provided by plates attached to the upper portion and the lower portion respectively.

27. A slider element as set forth in claim 11, wherein the sliding surfaces by way of which forces are transmitted in the working stroke are bigger than the sliding surfaces by way of which forces are transmitted in the rearward stroke.

28. A slider element as set forth in claim 11, wherein the first angle is equal to the second angle.

29. A slider element as set forth in claim 13, wherein the sliding plates of the dovetail shaped side are generally L-shaped in cross-section such that the first sliding surface and the second sliding surface form a corner of the L-shaped cross-section, the corner abutting the narrowing neck portion.

* * * * *